US006857403B2

(12) United States Patent
Diehl et al.

(10) Patent No.: US 6,857,403 B2
(45) Date of Patent: Feb. 22, 2005

(54) HYDRAULICALLY CONTROLLED ACTUATOR FOR ACTIVATING A VALVE

(75) Inventors: Udo Diehl, Stuttgart (DE); Karsten Mischker, Leonberg (DE); Bernd Rosenau, Tamm (DE); Uwe Hammer, Hemmingen (DE); Stefan Reimer, Markgroeningen (DE); Volker Beuche, Stuttgart (DE); Peter Lang, Weissach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/416,107

(22) PCT Filed: Jun. 25, 2002

(86) PCT No.: PCT/DE02/02318

§ 371 (c)(1),
(2), (4) Date: Oct. 9, 2003

(87) PCT Pub. No.: WO03/027450

PCT Pub. Date: Apr. 3, 2003

(65) Prior Publication Data

US 2004/0055547 A1 Mar. 25, 2004

(30) Foreign Application Priority Data

Sep. 7, 2001 (DE) ..... 101 43 959

(51) Int. Cl.[7] ..... F01L 9/02

(52) U.S. Cl. ..... 123/90.12; 123/90.13; 123/90.48; 123/90.49

(58) Field of Search ..... 123/90.12, 90.13, 123/90.48, 90.49; 92/172, 174, 183, 184; 137/906

(56) References Cited

U.S. PATENT DOCUMENTS

| | | | | |
|---|---|---|---|---|
| 3,209,737 A | | 10/1965 | Takeo et al. | |
| 5,022,358 A | * | 6/1991 | Richeson | 123/90.12 |
| 2001/0002379 A1 | | 5/2001 | Schechter | |

FOREIGN PATENT DOCUMENTS

| | | |
|---|---|---|
| DE | 038 41 997 | 6/1989 |
| DE | 198 26 047 | 12/1999 |
| EP | 0 391 507 | 10/1990 |
| SE | 353 575 | 2/1973 |

* cited by examiner

*Primary Examiner*—Thomas Denion
*Assistant Examiner*—Ching Chang
(74) *Attorney, Agent, or Firm*—Kenyon & Kenyon

(57) ABSTRACT

An hydraulically controlled actuator for activating a valve, especially for activating a gas-exchange valve in a combustion cylinder of an internal combustion engine, which includes two fluid-filled pressure chambers having controllable chamber volumes and a movable operating piston which delimits the pressure chambers by piston sides facing away from one another, the operating piston acting upon the valve and having an effective closing area acted upon by fluid pressure in the pressure chambers to close the valve and an effective opening area acted upon by the fluid pressure to open the valve. To influence the kinematics of the opening and closing movement of the valve, the operating piston is such that the surface area of at least one of the two effective areas changes along the sliding path of the operating piston.

12 Claims, 2 Drawing Sheets

HYDRAULICALLY CONTROLLED ACTUATOR FOR ACTIVATING A VALVE

FIELD OF THE INVENTION

The present invention is directed to an hydraulically controlled actuator for activating a valve, especially a gas-exchange valve in a combustion cylinder of an internal combustion engine.

BACKGROUND INFORMATION

A hydraulically controlled actuator for activating a valve, especially a gas-exchange valve in a combustion cylinder of an internal combustion engine, may be used in devices for the electro-hydraulic valve control of intake and exhaust valves in combustion cylinders of internal combustion engines, one actuator in each case being assigned to one gas exchange valve used as intake or discharge valve.

In a device for controlling a gas-exchange valve (DE 198 26 047 A1), the operating piston connected to the valve tappet of the gas-exchange valve is guided in a working cylinder in an axially movable manner and, by its end faces which face away from one another, delimits the two pressure chambers formed in the working cylinder. While the one first pressure chamber, via which a piston movement in the direction of valve closing is effected, is always acted upon by pressurized fluid, the other second pressure chamber, via which a piston movement in the direction of valve opening is effected, is selectively acted upon by pressurized fluid or discharged again to approximately ambient pressure with the aid of solenoid valves. The pressurized fluid is provided by a controlled pressure supply. The solenoid valves are embodied as 2/2 directional control valves, a first solenoid valve connecting the second pressure chamber to the pressure supply, and a second solenoid valve connecting the second pressure chamber to a discharge line. In the closed state of the gas-exchange valve, the closed solenoid valve. separates the second pressure chamber from the pressure supply, and the open second solenoid valve connects it to the discharge line, so that the operating piston is brought into its closing position by the fluid pressure prevailing in the first pressure chamber. To open the gas-exchange valve, both solenoid valves are energized. Due to the switching solenoid valves, the second pressure chamber is blocked from the discharge line and connected to the pressure supply. The gas-exchange valve opens, the magnitude of the opening lift being dependent on the formation of the electric control signal applied to the first solenoid valve, and the opening speed being dependent on the fluid pressure input by the pressure supply. In order to keep the gas-exchange valve in a particular open position, the first solenoid valve is subsequently de-energized, so that it once again separates the second pressure chamber from the current supply. To close the gas-exchange valve, the second solenoid valve is de-energized. As a result, the second pressure chamber is connected to the discharge line, and the fluid pressure prevailing in the first pressure chamber guides the operating piston back into its valve-closure position, the valve thus being closed by the operating piston. In this manner, it is possible to use an electric control device to generate control signals for the solenoid valves by which any desired valve-opening position of the gas-exchange valve are able to be adjusted.

SUMMARY OF THE INVENTION

The hydraulically controlled actuator according to the present invention for actuating a valve has the advantage over the related art that by a defined change in the effective opening and/or closing area of the working piston, the kinematics of the opening and/or closing movement of the valve are able to be controlled within broad limits in a very precise manner as a function of the operating piston's sliding path. For instance, during the opening procedure of the valve, a high adjusting force may first be generated on the valve for a fraction of the total valve lift. This high adjustment force is then markedly reduced again for the remaining lift of the valve. Such an opening characteristic curve is of great advantage especially in the case of gas-exchange valves in combustion cylinders of an internal combustion engine; for, in particular on the discharge side of the combustion cylinders, there is a need for an initially high opening force of the actuator, so that the gas-exchange valve may open against the residual gas pressure in the combustion cylinder. If, following a pressure compensation between combustion chamber and discharge channel, the actuating force is then lowered for the further opening operation of the valve, the energy required for the opening travel of the gas-exchange valve is considerably reduced. Overall, it is possible to reduce the energy consumption of an electro-hydraulic valve control within the valve lift by optimizing the change in the effective opening area in accordance with the particular requirements.

Furthermore, the solenoid valve determining the opening onset of the gas-exchange valve and the maximum lift of the gas-exchange valve may be designed for a smaller flow rate. The reason for this is that, upon initiation of the valve opening procedure by the closing of the second solenoid valve toward the discharge line and the opening of the first solenoid valve to the pressure supply, at first only enough fluid flows into the second pressure chamber to raise the pressure in the second pressure chamber. As soon as the opening force, resulting from the pressure and effective opening area, overcomes the existing frictional forces, the operating piston begins to move in the opening direction of the gas-exchange valve. In the process, the flow rate through the first solenoid valve resulting from the expansion of the chamber volume in the second pressure chamber does not rise abruptly, but steadily from zero to a maximum value. The large effective opening area of the operating piston thus is effective at a time when the flow rate through the open first solenoid valve has not yet reached its maximum value. The reduction in the effective opening area sets in early enough to limit the maximum flow rate through the first solenoid valve to a low level. This level is less than the level that would result if the effective opening area of the operating piston were kept constant over the lift.

According to an exemplary embodiment of the present invention, the closing operation of the valve also may be influenced by the formation of the effective closing area of the operating piston as a function of its sliding path in that the valve member, in the course of the piston movement, sets down on the valve seat with a reduced closing force, as a result of a timely reduction in the effective closing area of the operating piston. This advantage is particularly important for the activation of gas-exchange valves in combustion cylinders of an internal combustion engine. For there is a need, especially on the intake side of the combustion cylinder, both for a rapid closing of the intake valve and also for a low striking speed of the valve member on the valve seat on the side of the combustion cylinder. This striking speed, for noise and wear reasons, must not exceed certain limiting values, for instance, approximately 0.5 m/s at idling speed and approximately 0.5 m/s at maximum speed. By the reduction of the effective closing area of the operating piston shortly before reaching the closing position of the gas-exchange valve, as proposed by an exemplary embodiment of the present invention, the opening force of the actuator is reduced, thereby making a first contribution towards observing these limiting values.

According to an exemplary embodiment of the present invention, the operating piston operates so that, when the operating piston moves out of its valve position, the effective opening area of the operating piston is reduced by a predefined amount following at least one predefined sliding path.

According to an exemplary embodiment of the present invention, this is realized by the operating piston having a multi-part design and being made up of at least two concentric partial pistons which have different axial lengths and are able to be moved relative to one another. They are inserted into one another in such a way that the second pressure chamber is delimited by all front faces and the first pressure chamber only by a part of the front faces of the partial pistons. The sliding path of the at least one partial piston not delimiting the first pressure chamber is reduced relative to the overall sliding path of the operating piston, the reduction occurring in a stepped manner in the case of more than two partial pistons.

According to another embodiment of the present invention, the operating piston is designed in such a way that, when the operating piston moves out of its valve-closure position, the effective opening area is larger in the leading area of the sliding path than it is in the rest of the sliding path. When the operating piston is moved out of its valve-opening position, the effective closing area in the end area of the sliding path is smaller than it is in the rest of the sliding path.

According to an exemplary embodiment of the present invention, the operating piston is embodied as a stepped piston having a plurality of piston sections with different diameters. The operating piston has a center piston section which has the largest diameter; a lower inner piston section, which continues from the center piston section and extends through the first pressure chamber and has a smaller diameter than the center piston section; an upper inner piston section which continues from the center piston section and extends through the second pressure chamber and has a reduced diameter compared to the diameter of the lower inner piston section; and an outer piston section which in each case is located at an end of the inner piston sections and whose diameter is in each case larger than the diameter of the adjoining inner piston section.

This not only realizes an effective opening and closing area of the operating piston that changes in a defined manner across the sliding path of the operating piston, but in the case of closing also achieves a secondary effect which, in addition to the effective closing area of the operating piston which is reduced prior to the end of the closing movement, contributes to the reduction in the closing force. Due to the described graduated diameter design of the piston sections of the operating piston, the diameter of the operating piston in the second pressure chamber changes shortly before the end of the closing movement and the piston area delimiting the second pressure chamber is thus increased. This causes an increase in the discharging fluid stream. The open second solenoid valve, which at this time acts as a constant throttle toward the discharge line, opposes this increased fluid flow by an increased back-pressure, so that the pressure force acting in the first pressure chamber in the closing direction, which is reduced shortly before the end of the closing movement, is met by a rapidly generated counter force acting in an opposite direction. This counter force brakes the operating piston and in this way makes it possible to attain the aforementioned limiting values for the striking speed of the valve member on the valve seat as a result of the reduced closing force of the operating piston. Consequently, special devices for reducing the striking speed of the valve member on the valve seat of the gas-exchange valve, which have been used until now, may be dispensed with.

DETAILED DESCRIPTION

Figure 1:
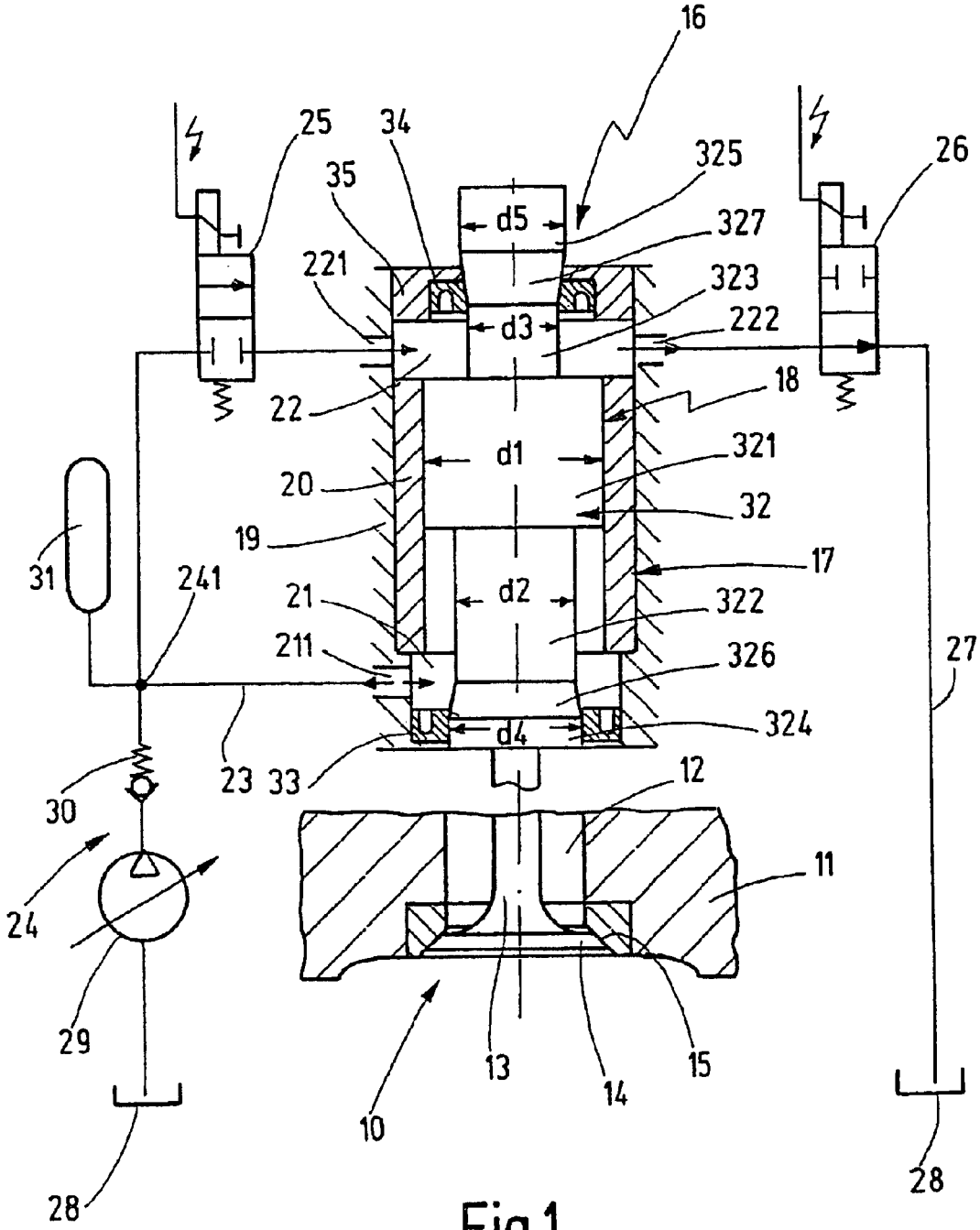
FIG. 1 shows a circuit diagram of a device for controlling a gas-exchange valve including an actuator, shown in longitudinal section, for actuating the gas-exchange valve, which is represented in a part-sectional longitudinal view.

In the device for controlling a gas-exchange valve in a combustion cylinder of an internal combustion engine, shown in FIG. 1 as a circuit diagram, gas-exchange valve 10 controls an opening-cross section 12 in a combustion cylinder 11, which is indicated in FIG. 1 by a section of its cylinder wall. Gas-exchange valve 10 may be used as an intake valve for controlling an intake cross section, and as a discharge valve for controlling a discharge cross section in combustion cylinder 11. Gas-exchange valve 10 includes a valve tappet 13 at whose one end a plate-shaped valve-sealing surface 14 is situated which, in order to control opening cross section 12, cooperates with a valve-seat surface 15 which is formed on the cylinder wall of combustion cylinder 11 and encloses opening-cross section 12. To open gas-exchange valve 10, valve-sealing surface 14 is lifted off from valve-seat surface 15 to a greater or lesser extent by the movement of valve tappet 13. To close gas-exchange valve 10, valve-seat surface 14 is pressed firmly onto valve-seat surface 15 by the opposing movement of valve tappet 13.

An hydraulically controlled actuator 16 is provided to open and close gas-exchange valve 10; it has a working cylinder 17 and an operating piston 18 which is guided in working cylinder 17 so as to be axially movable. In the exemplary embodiment of actuator 16 in FIG. 1, working cylinder 17 is realized by a bore introduced in a housing 19 into which a guide sleeve 20 is inserted to guide operating piston 18 and which is appropriately sealed at the front end. Operating piston 18, which is fixedly connected to valve tappet 13, divides working cylinder 17 into two hydraulic pressure chambers 21, 22 which are bounded by it at front faces that face away from one another. Lower first pressure chamber 21 has a connection piece 211, and upper second pressure chamber 22 has two connection pieces 221, 222. Via connection pieces 211, 221, 222, the two pressure chambers 21, 22 are filled with a fluid, such as hydraulic oil. For this purpose, connection piece 211 of first pressure chamber 21 is connected to a controllable pressure-supply device 24 by way of a pressure line 23, and connection piece 221 of second pressure chamber 22 is connected thereto via a first solenoid valve 25, while connection piece 222 of second pressure chamber 22 is connected, via a second solenoid valve 26, to a discharge line 27 which leads to a fluid reservoir 28. Both solenoid valves 25, 26 are embodied as two-way directional control valves having spring readjustment, which are activated for their switching by an electronic control device (not shown here). In the rest position, or basic position, of both solenoid valves 25, 26, which is shown in FIG. 1, second pressure chamber 22 is separated from pressure-supply device 24 and connected to discharge line 27. The fluid pressure prevailing in second pressure chamber 22 corresponds approximately to the ambient pressure.

Pressure-supply device 24 includes a controllable high-pressure pump 29 which draws in fluid from fluid reservoir 28; a check valve 30 and a reservoir 31 to dampen pulsations and store energy. A permanent high pressure, which is input into first pressure chamber 21, is present at output 241 of pressure-supply device 24, to which both pressure line 23 and also first solenoid valve 25 are connected.

Figure 2:
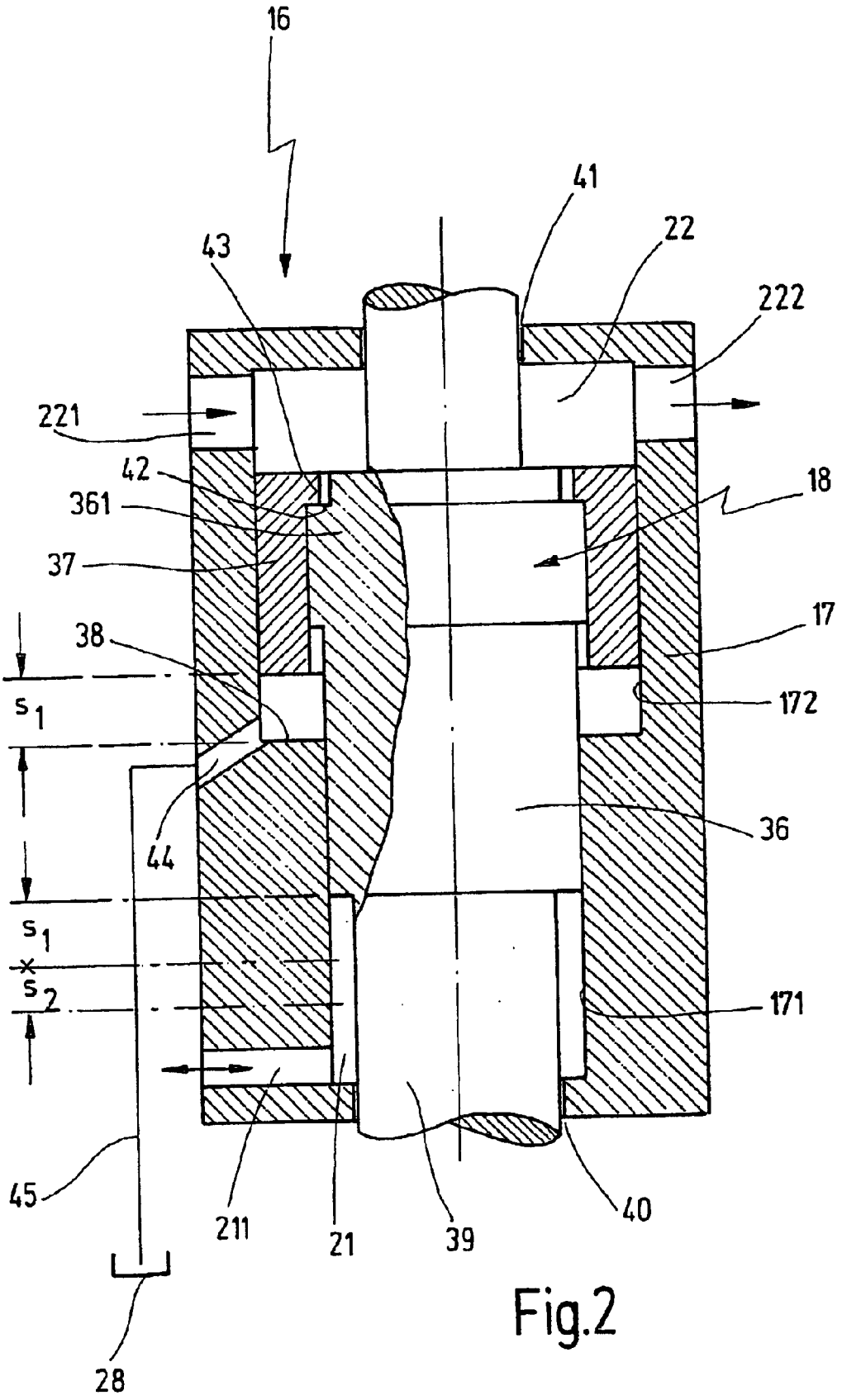
FIG. 2 shows a longitudinal section of an actuator for actuating a gas-exchange valve according to an additional exemplary embodiment.

Operating piston 18 of actuator 16, which is embodied in the exemplary embodiment of FIG. 1 as stepped piston 32 and as a multi-part piston in FIG. 2, has an effective closing area which, for the closing of gas-exchange valve 10, i.e., the movement of operating piston 18 in the valve-closure direction, is acted upon by the fluid pressure in pressure chambers 21, 22, and an effective opening area which, for the opening of gas-exchange valve 10, i.e., for the movement of operating piston 18 in the opening direction of gas-exchange valve 10, is acted upon by the fluid pressure in pressure chambers 21, 22. Both effective areas are made up of various annular surfaces formed on operating piston 18 and acted upon by the fluid pressure in pressure chambers 21, 22, as will also be described below.

To achieve defined kinematics of actuator 16 during the opening and closing of gas-exchange valve 10, which must meet specific demands on gas-exchange valve 10, operating piston 18 is designed in such a way that the surface area of the effective areas change along the sliding path of operating piston 18, namely the surface area of the effective opening area upon movement of operating piston 18 to generate an opening lift at gas-exchange valve 10, and the effective closing area upon the opposite movement of operating piston 18 to generate a closing movement of gas-exchange valve 10.

These demands made on actuator 16 are, on the one hand, a high opening force at the beginning of the opening lift, so that a pressure compensation between front and rear of gas-exchange valve 10 may take place, and a substantial reduction in the adjustment force following this fraction of the overall lift, on the other hand, so that the energy demand required to adjust the gas-exchange valve is reduced. Furthermore, a rapid closing of gas-exchange valve 10 is required as well, wherein the striking speed of valve-sealing surface 14 on valve-seat surface 15 should be as low as possible for noise and wear reasons.

These demands are taken into account in that operating piston 18 is designed in such a way that, when operating piston 18 is moved out of its valve-closure position, as it is shown in FIG. 1, the effective opening area in the leading area of the sliding path is greater than it is in the remaining sliding path and, when operating piston 18 is moved out of its valve-opening position, the effective closing area in the end area of the sliding path is smaller than it is in the rest of the sliding path. This design of operating piston 18 is realized in stepped piston 32 shown in FIG. 1 in that the following are provided in stepped piston 32: a center piston section 321 which has the largest diameter d1; an inner piston section which in each case adjoins center piston section 321 at the top and bottom, specifically, a lower inner piston section 322 extending through first pressure chamber 21, which has a reduced diameter d2 in relation to diameter d1 of center piston section 321; and an upper inner piston section 323 which extends through second pressure chamber 22 and has a reduced diameter d3 in relation to diameter d2 of lower inner piston section 321; and in each case an outer piston section 324 and 325 which has a larger diameter d4 and d5, respectively, in relation to that of adjoining inner piston section 322 and 323 and which adjoins at the end of lower inner piston section 322 and upper inner piston section 323.

Formed between inner and outer piston sections 321 and 322, 323, in each case is a transition zone 326 and 327 in which the diameter continually increases from diameter d2 or d3 of adjoining inner piston section 322 or 323, respectively, toward larger diameter d4 or d5 of outer piston sections 324, 325. Instead of a linear increase—as shown in FIG. 1—of the diameter in transition zones 326, 327, another geometric design of transition zone 326, 327 may be chosen to thus influence the lift-dependent characteristics of the effective opening and closing area.

When, during the lift movement, stepped piston 32 in the described embodiment moves out of its closing position, which is shown in FIG. 1, the effective opening area at the opening onset results from the difference of the two annular areas having annular width d1–d3 and the annular area having annular width d1–d4. Therefore, the effective opening area is the resulting annular area having annular width d4–d3 at stepped piston 32. If, following an initial lift, stepped piston 32 has moved to such a degree that lower outer piston section 324 or the adjoining transition zone 326 is pushed out of first pressure chamber 21 and upper outer piston section 325 or upper transition zone 327 plunges into second pressure chamber 22, the effective opening area is formed from the difference of the annular area having annular width d1–d5 and the annular area having annular width d1–d2. The effective opening area, thus, is the resulting annular area having annular width d2–d5 at stepped piston 32, which remains unchanged until the end of the opening lift. Since annular width d4–d3 is greater than annular width d2–d5, the effective opening area is substantially reduced after a fraction of the overall lift of stepped piston 32.

During the closing procedure of gas-exchange valve 10 when stepped piston 32 moves back into its valve-closure position shown in FIG. 1, the effective closing area at the beginning of the closing lift is formed by the annular area at stepped piston 32 having annular width d1–d2. Prior to the end of the closing lift, lower transition zone 326 and adjoining outer piston section 324 plunge into first pressure chamber 21, thereby reducing the effective closing area to the annular area having annular width d1–d4. Thus, the closing movement of stepped piston 32 initially occurs with great closing force, due to the larger effective closing area, and with reduced closing force in the end region of the closing lift, due to the reduced effective closing area. In each instance, a high-pressure seal 33 or 34, which is held in working cylinder 17 and presses against stepped piston 32, seals pressure chambers 21, 22 from stepped piston 32. High-pressure seal 34 of second pressure chamber 22 is integrated in a cover 35 which seals working cylinder 17 toward the top.

A secondary effect is additionally achieved during the closing procedure in that the diameter of operating piston 32 in second pressure chamber 22 changes shortly before the end of closing, due to the emergence of piston sections 325 and 327, so that the operating-piston area delimiting second pressure chamber 22 is enlarged. This causes an increase in the displacement volume of operating piston 32 in second pressure chamber 22, which, due to the throttling of the displacement volume in open second solenoid valve 26, leads to a rapid increase in the counteracting force opposing the closing movement of operating piston 22. This counteracting force brakes operating piston 22 and, in combination with the reduced closing force of operating piston 22, substantially reduces the striking speed of valve tappet 13 on valve-seat surface 14 of gas-exchange valve 10.

Actuator 16, schematically shown in FIG. 2 in longitudinal section, is modified compared to actuator 16 shown in FIG. 1 and described above, to the extent that operating piston 18 is designed in such a way that, when operating piston 18 moves out of its valve-closure position, as it is shown in FIG. 2, the effective opening area is reduced by a predefined value following at least one predefined sliding path and remains constant until the end of the lift, whereas the effective closing area remains constant when operating piston 18 moves into its valve-closure position, that is, over the entire closing lift. Thus, gas-exchange valve 10 is rapidly opened with great displacement force, which then rapidly drops and remains constant over the rest of the lift. Instead of actuator 16 in FIG. 1, it is also possible to use actuator 16 according to FIG. 2 in the device described there for controlling a gas-exchange valve 10 in combustion cylinder 11 of an internal combustion engine. The connections of connecting pieces 211, 221 and 222 of working cylinder 17 are integrated in the control device, as shown in FIG. 1. Components of actuator 16 in FIG. 2 which correspond to components of actuator 16 in FIG. 1, bear the same reference numerals, so that in this respect the explanations relating to FIG. 1 correspondingly apply to actuator 16 according to FIG. 2 as well.

The previously mentioned modified design of operating piston 18 with the lift-dependent change in the effective opening area is achieved by the fact that operating piston 18 has a plurality of parts and has two partial pistons 36 and 37 in the exemplary embodiment of FIG. 2. The two partial pistons 36, 37 have different axial lengths; they are concentrically inserted inside each other so as to be movable relative to each another, in such a way that both partial pistons 36, 37 delimit second pressure chamber 22 and only inner partial piston 36 delimits first pressure chamber 21. Working cylinder 17 has a stepped design. Upper cylinder section 172, which has a larger diameter, accommodates both partial pistons 36, 37, and lower cylinder section 171 of working cylinder 17 guides only inner partial piston 36. Shorter outer partial piston 37 is guided in upper section 172 of working cylinder 17 by working cylinder 17, on the one hand, and by a guide section 361, which is formed on inner partial piston 36 and has a slightly enlarged diameter, on the other hand, while longer inner partial piston 36 is guided in lower cylinder section 171 of the working cylinder. Formed by the cylinder wall of working cylinder 17 is a stop 38 which delimits the sliding path of outer partial piston 37 to sliding path s1, while the sliding path of longer inner partial piston 36 corresponds to the overall lift s1 +s2 of operating piston 18. Inner partial piston 36 is either integrally formed with a piston rod 39, as this is shown in FIG. 2, or pressed onto piston rod 39 as an annular member. Piston rod 39 emerges from working cylinder 17 via sealed openings 40, 41. A valve tappet 13 is fastened to piston rod 39. Alternatively, piston rod 39 may be formed by valve tappet 13 itself.

When operating piston 18 moves out of its valve-closure position, shown in FIG. 2, in the direction of valve opening, which is accomplished by applying fluid pressure in second pressure chamber 22, both partial pistons 36, 37 are acted upon by pressure in second pressure chamber 22 and are moved. The effective opening area of operating piston 18 is made up of the two annular end faces of the two partial pistons 36, 37 and is maximal, the end faces delimiting second pressure chamber 22. When operating piston 18 has completed valve travel s1, outer partial piston 37 strikes against stop 38 and does no longer participate in the further displacement movement of operating piston 18. The effective opening area of operating piston 18 is thus reduced to the front face of inner partial piston 36, which is acted upon by the fluid pressure, so that the displacement force of actuator 16 is reduced and the energy demand of actuator 16 drops during the further opening of gas-exchange valve 10.

If, when reaching the opening position of gas-exchange valve 10, the closing procedure is initiated by discharging first pressure chamber 22, a driver pin 42 between the two partial pistons 36, 37 becomes effective upon inner partial piston 36 having traveled sliding path s2. Inner partial piston 36 takes along outer partial piston 37 via sliding path S1, up to the closing position of operating piston 18. Driver pin 42 is realized by an annular bar 43 which radially projects from the inner side of outer partial piston 37. Guide section 361 of inner partial piston 36, which has a larger cross section, strikes against this annular bar 43.

to ensure that the fluid passing through between partial pistons 36, 37 drains from upper section 172 of working cylinder 17, a leakage bore 44 is provided in the housing wall of working cylinder 17 in the transition between the two sections 172, 171 of working cylinder 17. This leakage bore 44 ends in upper section 172 of working cylinder 17 and is used to return the fluid leakage to fluid reservoir 28 via a return line 45. In a further development of the described operating piston 18, it may also be constructed from more than just two partial pistons. In that case, the individual partial pistons will also have different lengths and lose their effectiveness in the further movement of operating piston 18 by an appropriate definition of their valve travel, so that the effective opening area of operating piston 18 changes several times in the course of its overall valve travel.

What is claimed is:

1. A hydraulically controlled actuator for activating a gas-exchange valve in a combustion cylinder of an internal combustion engine, comprising:

two fluid-filled pressure chambers whose chamber volume is controllable; and an operating piston acting upon the valve and being movable out of and into a valve-closure position and a valve-opening position, the operating piston delimiting the pressure chambers by piston sides facing away from one another, and having an effective closing area, acted upon by the fluid pressure in the pressure chambers to close the valve, and an effective opening area acted upon by a fluid pressure in the pressure chambers to open the valve, wherein the operating piston operates so that a real surface of at least one of the effective closing and opening areas changes along the sliding path of the operating piston wherein:

the operating piston operates so that, when the operating piston moves out of its valve-closure position, the effective opening area is reduced by a predefined value following at least one predefined sliding path; and the operating piston has multiple parts and is made up of concentric partial pistons, which have differing axial lengths and are moveable relative to each other, and which are insertable into each other so that a second one of the pressure chambers is delimited by all, and a first one of the pressure chambers only by a portion of partial pistons, and sliding paths of the partial pistons not delimiting the first one of the pressure chambers are reduced in a step-wise manner relative to an overall sliding path of the operating piston.

2. A hydraulically controlled actuator for activating a gas-exchange valve in a combustion cylinder of an internal combustion engine, comprising:

two fluid-filled pressure chambers whose chamber volume is controllable; and an operating piston acting upon the valve and being movable out of and into a valve-closure position and a valve-opening position, the operating piston delimiting the pressure chambers by piston sides facing away from one another, and having an effective closing area, acted upon by the fluid pressure in the pressure chambers to close the valve, and an effective opening area acted upon by a fluid pressure in the pressure chambers to open the valve, wherein the operating piston operates so that a real surface of at least one of the effective closing and opening areas chances along the sliding path of the operating piston, wherein a first one of the pressure chambers, which acts upon the operating piston with a fluid pressure in a sliding direction causing a valve closing, is permanently filled with a pressurized fluid, and a second one of the pressure chambers, which acts upon the operating piston with a fluid pressure in a sliding direction causing a valve opening, is alternately fillable with pressurized fluid and dischargeable again.

3. The actuator of claim 1, wherein in each case a stop is positioned in the sliding path of the partial pistons which blocks the sliding path, an associated one of the partial pistons striking the stop after traveling its reduced sliding path.

4. The actuator of claim 1, wherein driver pins are located between the partial pistons, which are effective when the operating piston is moved out of its valve-opening position into its valve-closure position.

5. The actuator of claim 1, wherein the operating piston is assembled from two partial pistons, an outer partial piston has the smaller axial length and an inner partial piston is guided in a section, having a smaller diameter, of a working piston, and the outer partial piston is guided on the inner partial piston and in a section of a working cylinder having a larger diameter.

6. The actuator of claim 5, wherein, in a transition of the section of the working piston having the larger diameter to the section of the working piston having the smaller diameter, a leakage bore is introduced in the working piston which ends in the section having the larger diameter.

7. The actuator of claim 1, wherein when the operating piston is moved out of its valve-closure position, the effective opening area is greater in a leading area of the sliding path than it is in a subsequent sliding path, and, when the operating piston is moved out of its valve-opening position, the effective closing area in an end area of the sliding path is smaller than it is in a preceding sliding path.

8. The actuator of claim 7, wherein the operating piston includes a stepped piston having piston sections with different diameters.

9. The actuator of claim 8, wherein the operating piston includes a center piston section having a largest diameter, a lower inner piston section having a comparatively smaller diameter, a lower inner piston section continuing from the center piston section and extending through a first one of the pressure chambers, an upper inner piston section having a reduced diameter in comparison to the diameter of the lower inner piston section, the upper inner piston section continuing from the center piston section and extending through a second one of the pressure chambers, and, situated in each case at an end of the inner and outer piston sections whose diameter is larger than the diameter of an adjoining one of the inner piston sections.

10. The actuator of claim 9, wherein the outer piston sections are located on the operating piston so that, upon the operating piston beginning to move out of its valve-closure position, the lower outer piston section increasingly emerges from the first pressure chamber and, following a stipulated sliding path, the upper outer piston section increasingly plunges into the second pressure chamber and, toward an end of the movement of the operating piston out of its valve-opening position, the lower outer piston section increasingly plunges into the first pressure chamber.

11. The actuator of claim 9, wherein, between each outer and inner piston section, a transition zone is provided at the operating piston whose diameter increases steadily in a linear manner or following another mathematical interrelationship, from the diameter of the inner piston sections to the diameter of the outer piston sections.

12. The actuator of claim 8, wherein the operating piston, by its center piston section, is guided in an axially movable manner in a working cylinder forming the pressure chambers, and, in the region where the operating piston emerges from the two pressure chambers, the operating piston in each case is conducted through a high-pressure seal, which is affixed in the working cylinder and presses against the operating piston.

* * * * *